US011777264B2

(12) United States Patent
Cai

(10) Patent No.: US 11,777,264 B2
(45) Date of Patent: Oct. 3, 2023

(54) FUEL PUMP COMPONENT

(71) Applicant: ZHEJIANG SHUANGLIANG AUTOMOBILE PARTS CO., LTD., Lishui (CN)

(72) Inventor: Liangbao Cai, Lishui (CN)

(73) Assignee: ZHEJIANG SHUANGLIANG AUTOMOBILE PARTS CO., LTD., Lishui (CN)

( * ) Notice: Subject to any disclaimer, the term of this patent is extended or adjusted under 35 U.S.C. 154(b) by 269 days.

(21) Appl. No.: 17/294,688

(22) PCT Filed: Oct. 12, 2020

(86) PCT No.: PCT/CN2020/120291
§ 371 (c)(1),
(2) Date: May 18, 2021

(87) PCT Pub. No.: WO2021/189811
PCT Pub. Date: Sep. 30, 2021

(65) Prior Publication Data

US 2022/0311194 A1 Sep. 29, 2022

(30) Foreign Application Priority Data

Mar. 25, 2020 (CN) ..... 202020398344.3

(51) Int. Cl.
*H01R 24/66* (2011.01)
*H01R 4/48* (2006.01)

(52) U.S. Cl.
CPC ..... *H01R 24/66* (2013.01); *H01R 4/4809* (2013.01); *H01R 2201/26* (2013.01)

(58) Field of Classification Search
CPC .. H01R 24/66; H01R 4/4809; H01R 2103/00; H01R 2201/26; H01R 24/68; F02M 37/08
See application file for complete search history.

(56) References Cited

U.S. PATENT DOCUMENTS 7,452,247 B1 * 11/2008 Rahman ..... H01R 13/405 439/736
7,874,818 B2 1/2011 Gottschalk et al.
(Continued)

FOREIGN PATENT DOCUMENTS

CN 101939532 A 1/2011
CN 104300259 A 1/2015
(Continued)

*Primary Examiner* — Travis S Chambers
(74) *Attorney, Agent, or Firm* — Bayramoglu Law Offices LLC

(57) ABSTRACT

A fuel pump component is provided, including a housing and a cover that fit each other. A fuel pump core is provided in the housing and the fuel pump core is provided with an electrically conductive plate extending outside. A wiring terminal is provided on the cover. The wiring terminal is in electrical contact with the electrically conductive plate when the housing is fitted with the cover. A portion of the wiring terminal that extends outside the cover is bent laterally. A wiring holder covering the wiring terminal is provided on the cover, and the wiring holder has a lateral opening. The new fuel pump component prevents rainwater or dust from entering the wiring holder to ensure a reliable power supply.

9 Claims, 6 Drawing Sheets

(56) References Cited

U.S. PATENT DOCUMENTS

| | | | | |
|---|---|---|---|---|
| 8,133,040 | B2 * | 3/2012 | Takagi | F02M 37/08 417/423.15 |
| 8,651,832 | B2 * | 2/2014 | Ito | F02M 37/08 417/423.14 |
| 2006/0292913 | A1 * | 12/2006 | Milton | F04D 5/002 439/271 |
| 2011/0192381 | A1 * | 8/2011 | Maruyama | F02M 37/08 123/497 |
| 2018/0034179 | A1 | 2/2018 | Hashiguchi et al. | |

FOREIGN PATENT DOCUMENTS

| | | | |
|---|---|---|---|
| CN | 107004987 | A | 8/2017 |
| CN | 209557141 | U | 10/2019 |
| CN | 209557146 | U | 10/2019 |
| CN | 110546820 | A | 12/2019 |
| KR | 200162010 | Y1 * | 12/1999 |

* cited by examiner

FUEL PUMP COMPONENT

CROSS REFERENCE TO THE RELATED APPLICATIONS

This application is the national stage entry of International Application No. PCT/CN2020/120291, filed on Oct. 12, 2020, which is based upon and claims priority to Chinese Patent Application No. 202020398344.3, filed on Mar. 25, 2020, the entire contents of which are incorporated herein by reference.

TECHNICAL FIELD

The present invention relates to a fuel pump component disposed outside a fuel tank, and in particular, to a wiring technology of a pump core in the fuel pump component.

BACKGROUND

Chinese patent CN101939532A discloses a fuel delivery system for an engine, including an additional fuel pump located within a housing. The additional fuel pump operates on Direct Current (DC) voltage power. For example, the patented fuel pump can work with a battery on a utility engine equipped vehicle. In another example, the additional fuel pump can be configured to utilize other types of power (e.g., 6V DC power). Further, the additional fuel pump is supplied with electrical power by an electrical lead (not shown) passing through an exterior surface of the top portion of the housing. The external terminal of the electrical lead is situated in an electrical connector in the manner of plug-type fitting, which facilitates connection and disconnection from a power source, as shown in FIG. 3 of the above patent.

The electrical lead of the patented additional fuel pump passes through the housing and is connected to the external power supply. That is to say, in the connection process of the top portion and the bottom portion of the housing of the additional fuel pump, the top portion of the housing needs an electrical lead that penetrates through the additional fuel pump downwardly. Thus, the electrical lead must be vertically upward without bending. Furthermore, this introduces a problem in that an opening of an electrical connector located on the housing must be vertically upward, so that the plug-type fitting can be implemented to facilitate connection and disconnection from the power source. However, since the electrical connector is disposed to be vertically upward, rainwater or dust is more likely to enter the electrical connector to affect the electrical contact when it rains or in other situations.

SUMMARY

The purpose of the present invention is to provide a fuel pump component that has good electrical contact and prevents rainwater from entering.

In order to achieve the above purpose, the present invention provides a fuel pump component, including a housing and a cover that fit each other. A fuel pump core is provided in the housing and the fuel pump core has an electrically conductive plate extending outside. A wiring terminal is provided on the cover. The wiring terminal is in electrical contact with the electrically conductive plate when the housing is fitted with the cover. A portion of the wiring terminal extends outside the cover and is bent laterally. A wiring holder covering the wiring terminal is provided on the cover, and the wiring holder has a lateral opening. The fuel pump component is arranged in the above manner. The wiring terminal is provided on the cover, the wiring terminal is connected to the electrically conductive plate so that the wiring terminal can be bent outside of the cover and the plug-insertion manner is a lateral plug-insertion, thereby preventing rainwater or dust from entering the wiring holder and affecting the electrical contact of the fuel pump core and a power supply.

In order to further improve the electrical contact of the electrically conductive plate and the wiring terminal, the electrically conductive plate is connected to the wiring terminal through an elastic insertion plate having conductivity, and the elastic insertion plate has a clamping portion and a contact portion. The clamping portion clamps the electrically conductive plate or the wiring terminal, and the contact portion contacts the wiring terminal or the electrically conductive plate to electrically connect the electrically conductive plate with the wiring terminal.

In order to improve the reliability of the electrical contact, the clamping portion includes a left clamping arm and a right clamping arm. One end of the left clamping arm is connected to one end of the right clamping arm and the other end of the left clamping arm forms an elastic clamping opening. An abutting clamping surface is provided between the left clamping arm and the right clamping arm located at the clamping opening, and the contact portion is an external surface of the left clamping arm or an external surface of the right clamping arm opposing the clamping surface.

In order to improve the reliability of the electrical contact, the left clamping arm or the right clamping arm includes a connection arm A connected to the right clamping arm or the left clamping arm. The other end of the connection arm A is connected to a first bending portion extending obliquely upward toward the right clamping arm or the left clamping arm, and a second bending portion extending obliquely upward toward the connection arm A is connected to the first bending portion, and the first bending portion, the second bending portion and the connection arm A form a triangle shape.

In order to improve the reliability of the electrical contact, the right clamping arm or the left clamping arm includes a connection arm B connected to the left clamping arm or the right clamping arm. The other end of the connection arm B is connected to a third bending portion extending obliquely upward toward the left clamping arm or the right clamping arm, and the third bending portion abuts a connection portion of the first bending portion and the second bending portion to form the clamping opening.

Preferably, the connection arm A and the connection arm B are connected through a lateral connection arm C.

Preferably, the electrically conductive plate is clamped in the clamping opening. The wiring terminal acts on an external surface of the connection arm A and presses the connection portion of the first bending portion and the second bending portion against the electrically conductive plate clamped in the clamping opening.

Preferably, the electrically conductive plate is clamped in the clamping opening. The wiring terminal acts on an external surface of the connection arm B and presses the third bending portion against the electrically conductive plate clamped in the clamping opening.

ADVANTAGEOUS EFFECTS

In the fuel pump component of the present invention, a portion of the fuel pump core that contacts the power supply is divided into two parts, that is, a part is the electrically conductive plate extending outside on the fuel pump core in the housing, and another part is the wiring terminal that is fixedly provided on the cover, such that the electrically conductive plate is the electrically connected with the wiring terminal through the fitting of the housing and the cover. Meanwhile, the wiring terminal is directly provided on the cover, so that the wiring terminal laterally extends outside, and further the wiring holder having the lateral opening can be provided on the cover to implement the lateral plug-insertion with the power supply, which prevents rainwater from entering when it rains or prevents dust falling into the wiring holder, and improve the electrical contact with the power supply.

In addition, the electrically conductive plate of the present invention contacts the wiring terminal through the elastic insertion plate to ensure the reliability of the electrical contact while avoiding the process of welding or screwing, thereby having wide applicability.

EXPLANATIONS FOR REFERENCE NUMBERS

Figure 1:
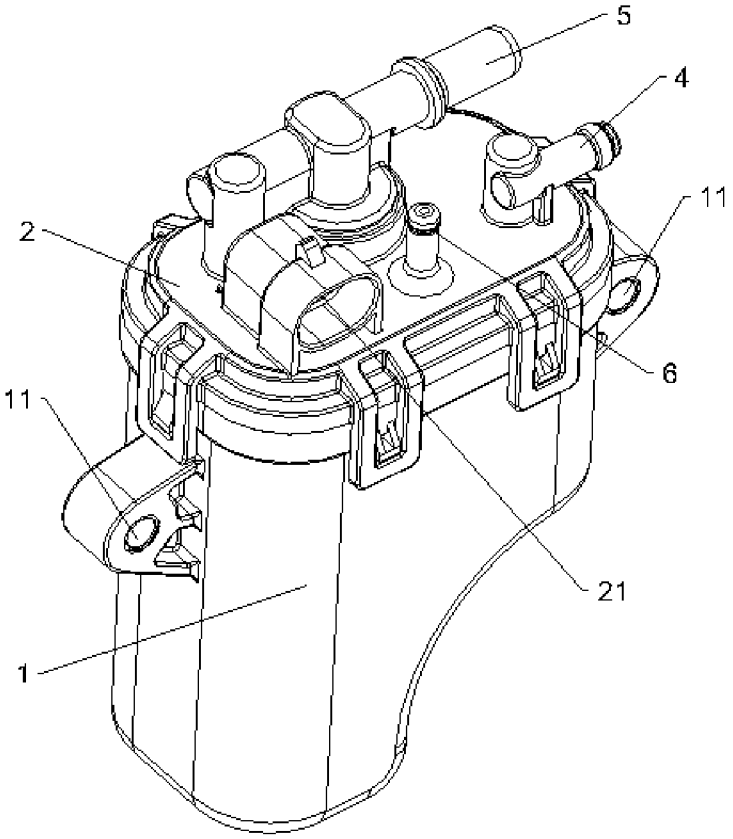
FIG. 1 is an axonometric diagram of a fuel pump component of the present invention.
Figure 2:
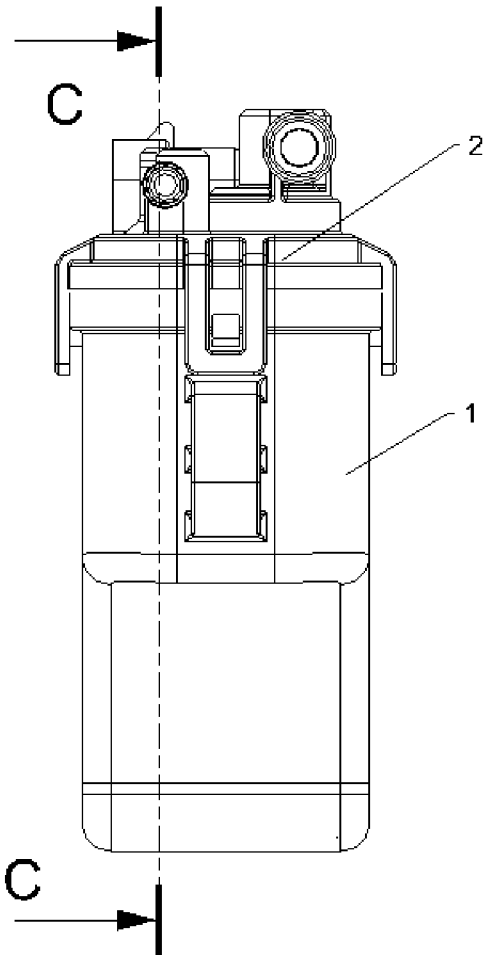
FIG. 2 is a right view of the fuel pump component of the present invention.
Figure 3:
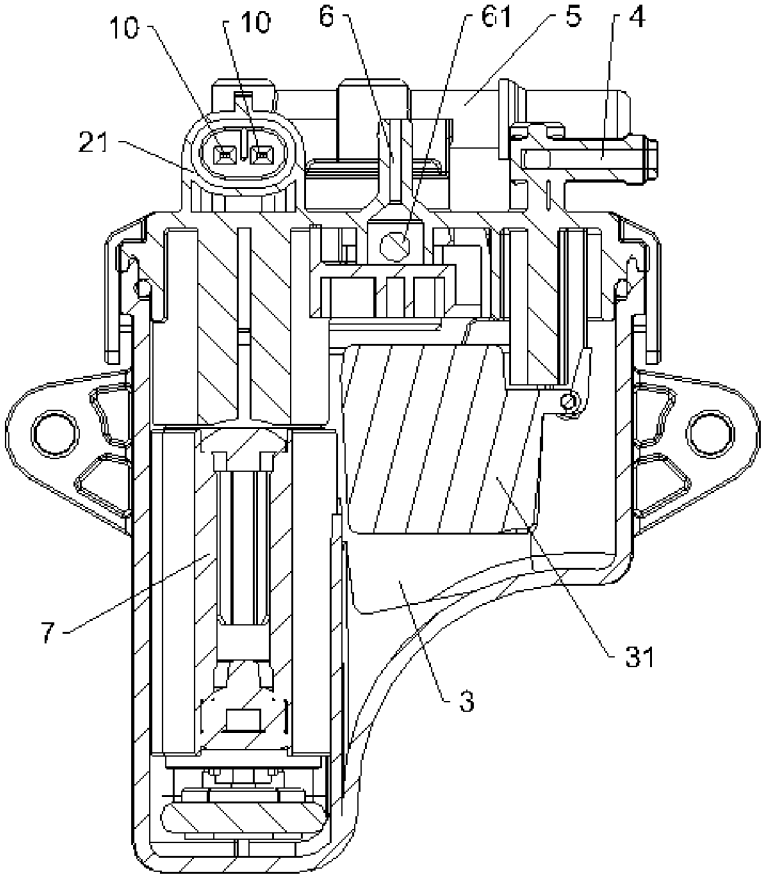
FIG. 3 is a cross-section view of FIG. 2.
Figure 4:
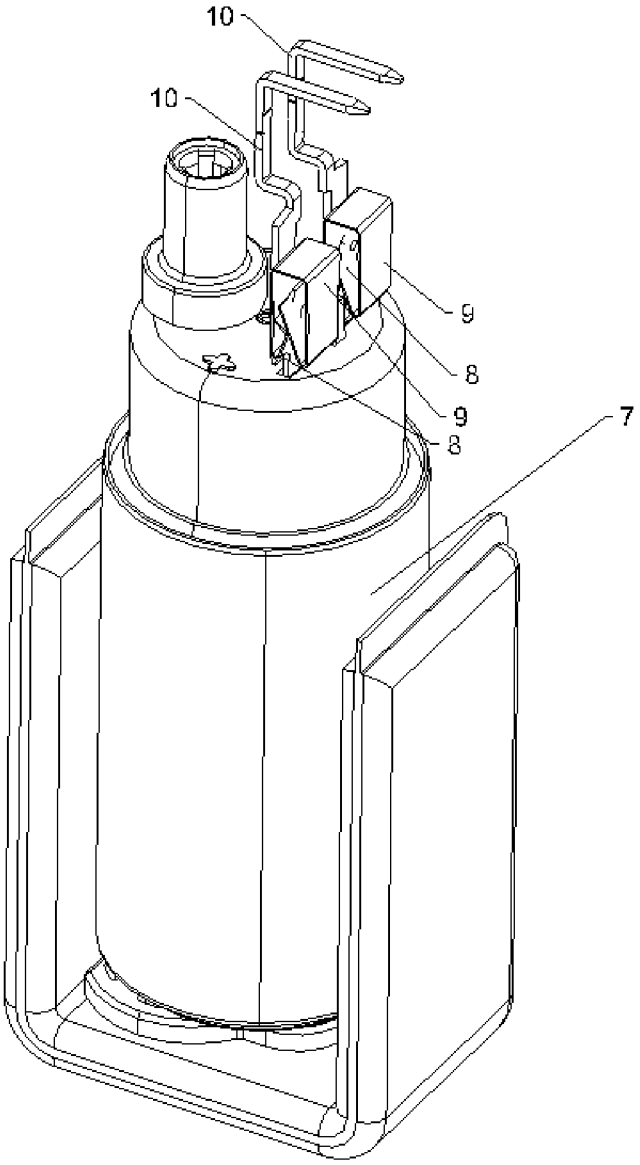
FIG. 4 is an axonometric diagram of a fuel pump core (including a wiring terminal) of the present invention.
Figure 5:
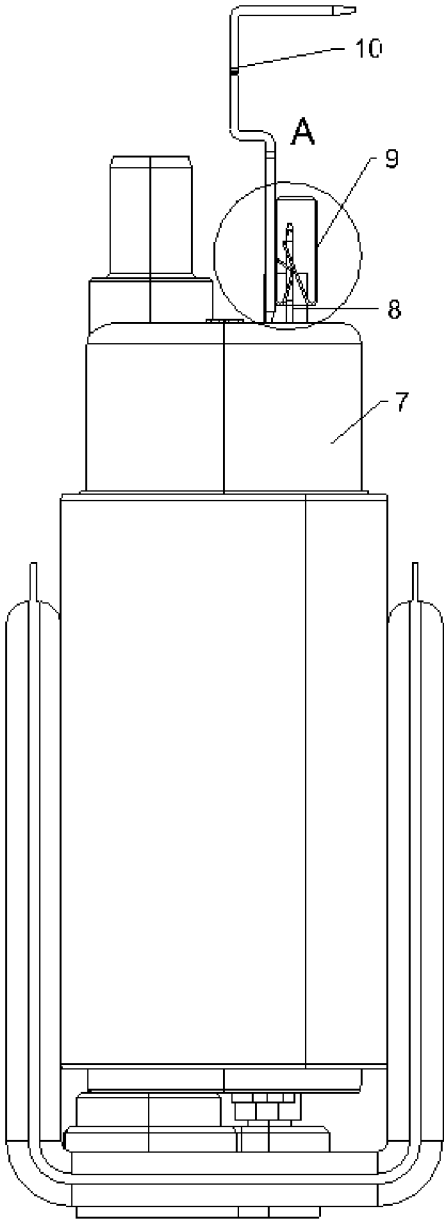
FIG. 5 is a left view of the fuel pump core of the present invention.

1. Housing, 2. Cover, 3. Fuel Chamber, 31. Floating Mechanism, 4. Fuel Inlet Pipe, 5. Fuel Outlet Pipe, 6. Exhaust Pipe, 61. Anti-turnover Mechanism, 7. Fuel Pump Core, 8. Electrically conductive plate, 9. Elastic Insertion plate, 10. Wiring Terminal, 91. Connection Arm C, 92. First Bending Portion, 93. Second Bending Portion, 94. Third Bending Portion, 95. Connection Arm A, 96. Connection Arm B.

DETAILED DESCRIPTION OF THE EXEMPLARY EMBODIMENTS

Exemplary embodiments of the present invention will be further described in detail in conjunction with the drawings below, but the present invention is not limited to these embodiments. Any improvement or replacement within the basic spirit of the present invention still belongs to the scope for protection of the claims of the present invention.

Embodiment 1

As shown in the drawings, the present embodiment provides a fuel pump component. The fuel pump component is provided between a fuel tank and an engine. The fuel in the fuel tank is pressurized to form low-pressure fuel, and then the low-pressure fuel enters the fuel pump component. A fuel pump core 7 is provided in the fuel pump component. The low-pressure fuel is further pressurized to form high-pressure fuel, and then the high-pressure fuel is pumped into the engine. In addition, the engine is a small general internal combustion engine that can be applied to various applications, such as a lawn mower, a snow sweeper or any other small vehicles for multiple usages.

The fuel pump component includes a housing 1 and a cover 2. The housing 1 is fitted with the cover 2 to form a fuel chamber 3. The cover is provided with a fuel inlet pipe 4 for connection with a fuel tank, and the fuel in the fuel tank is delivered to the fuel chamber through the pipe. The cover 2 is further provided with a fuel outlet pipe 5, and the fuel outlet pipe is connected to the engine through the pipe to deliver the fuel refueled by the fuel pump core 7 into the engine. Mounting holes 11 are respectively provided at both left and right sides of an outer wall of the housing to mount the fuel pump component on the engine or on a general machine. Moreover, a pressure regulation valve is mounted in the fuel chamber, fixed in the fuel chamber through a valve holder, and acts on the fuel outlet pipe to regulate the rate of flow of the fuel outlet pipe. A floating mechanism 31 is further provided in the fuel chamber, and acts on a fuel inlet end. When the fuel in the chamber reaches a certain height, the floating mechanism floats up to block the fuel inlet end and prevent the fuel from continuing to enter the fuel chamber. In addition, an exhaust pipe 6 vertically extending upward outside is further provided on the cover, and the exhaust pipe communicates with the fuel chamber to discharge gas generated by the evaporation of the fuel in the fuel chamber to the external environment, or guide fuel vapor in the exhaust pipe into an air intake system of the engine through a connector of the accessory. An anti-turnover mechanism 61 is provided in the fuel chamber at a lower portion of the exhaust pipe. In a case of normal operation, the exhaust pipe is vertically upward, and the fuel cannot be discharged outside through the exhaust pipe. However, when the fuel pump is severely shaken or turned over, the anti-turnover mechanism can block an exhaust port of the exhaust pipe to avoid fuel leakage from the exhaust pipe.

In the present embodiment, the fuel pump core 7 is provided in the housing. Two electrically conductive plates 8 extending outside are provided on the fuel pump core, and the two electrically conductive plates 8 a positive electrically conductive plate and a negative electrically conductive plate, respectively. Two wiring terminals 10 are provided on the cover, and the two wiring terminals 10 are electrically connected to the positive electrically conductive plate and the negative electrically conductive plate, respectively. The electrical connection can be established in a variety of ways, for example, the electrical contact of the wiring terminal and the electrically conductive plate can be directly implemented through the fitting of the housing and the cover. Alternatively, the contact reliability of the wiring terminal and the electrically conductive plate can be ensured through other conductive intermediate members. The wiring terminal 10 is in electrical contact with the electrically conductive plate 8 when the housing 1 is fitted with the cover 2. A portion of the wiring terminal extends outside the cover and is bent laterally. A wiring holder 21 covering the wiring terminal is provided on the cover, and the wiring holder 21 has a lateral opening.

In another implementation mode of the present embodiment, an elastic insertion plate 9 having conductivity is used as an intermediate member to implement the electrical contact of the wiring terminal and the electrically conductive plate. The elastic insertion plate 9 has a clamping portion and a contact portion. The clamping portion clamps the electrically conductive plate or the wiring terminal, and the contact portion contacts the wiring terminal or the electrically conductive plate to implement the electrical connection of the electrically conductive plate with the wiring terminal.

The clamping portion includes a left clamping arm and a right clamping arm. One end of the left clamping arm is connected to one end of the right clamping arm and the other end of the left clamping arm forms an elastic clamping opening. An abutting clamping surface between the left clamping arm and the right clamping arm is located at the clamping opening, and the contact portion is an external surface of the left clamping arm or an external surface of the right clamping arm opposing the clamping surface.

Specifically speaking, the left clamping arm includes a connection arm A 95 connected to the right clamping arm, and the other end of the connection arm A 95 is connected to a first bending portion 92 extending obliquely upward toward the right clamping arm. A second bending portion 93 extending obliquely upward toward the connection arm A is connected to the first bending portion. The first bending portion, the second bending portion and the connection arm A form a triangle shape. The right clamping arm includes a connection arm B 96 connected to the left clamping arm, and the other end of the connection arm B 96 is connected to a third bending portion 94 extending obliquely upward toward the left clamping arm. A distance between the third bending portion 94 and the connection arm B 96 becomes greater when the third bending portion 94 extends upward further. Moreover, the third bending portion abuts against the connection portion of the first bending portion and the second bending portion to form the clamping opening.

The left clamping arm and the right clamping arm as described above are merely based on the left and right sides limited in the drawings, and the actual situation can be contrary to the drawings. The terms "left" and "right" cannot be understood as the limitation to the present invention.

Figure 7:
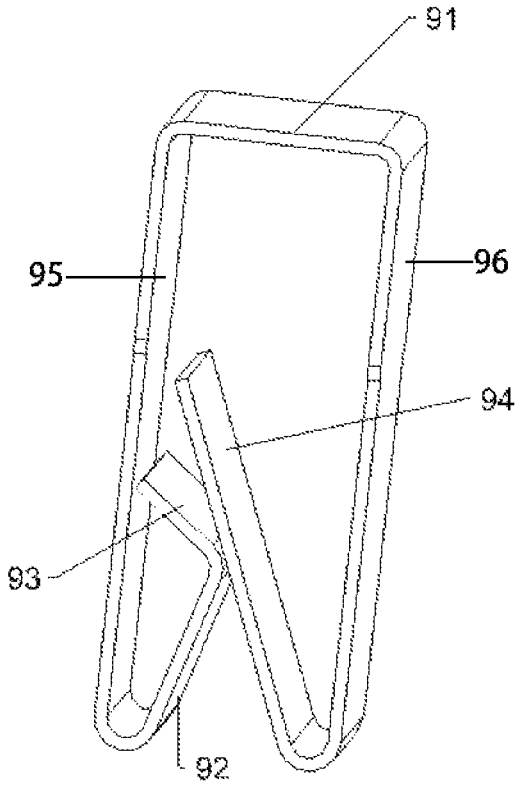
FIG. 7 is an axonometric diagram of an elastic insertion plate.

In another implementation mode of the present embodiment, the connection arm A 95 and the connection arm B 96 are connected through a lateral connection arm C 91. As shown in FIG. 7, the connection arm A, the connection arm B and the connection arm C form an inverted U shape. The elastic insertion plate of the present embodiment is integrated and molded through a bending manner.

Figure 6:
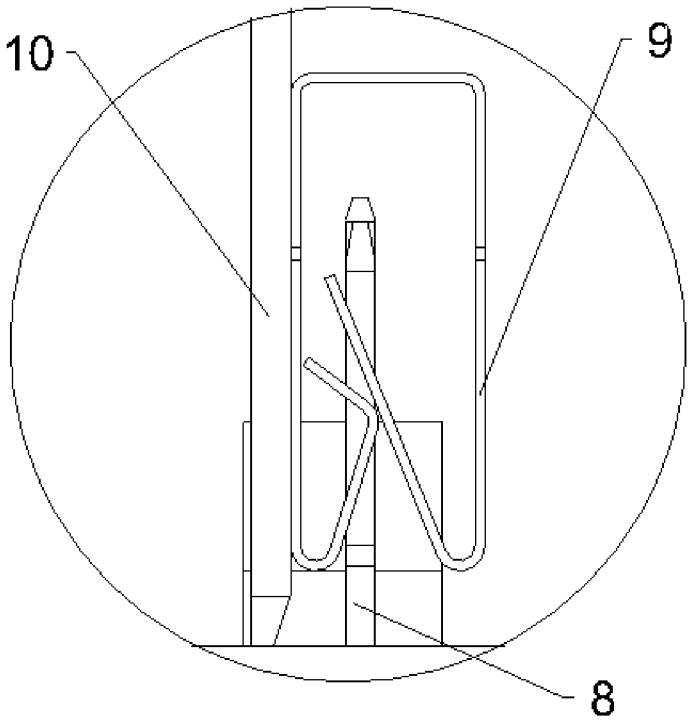
FIG. 6 is a partially enlarged diagram of FIG. 5.

In use, the clamping opening of the elastic insertion plate clamps the electrically conductive plate in advance. When the housing and the cover of the fuel pump component are mounted and fitted with each other, the wiring terminal acts on the outside of the connection arm A and presses a protruding portion at the connection portion of the first bending portion and the second bending portion against the electrically conductive plate clamped in the clamping opening so that the electrically conductive plate is tightly pressed against the protruding portion of the first bending portion and the second bending portion under the action of the third bending portion. In this way, it can be ensured that the electrically conductive plate and the wiring terminal form firm electrical contact during the operation process to ensure the reliability of the power supply of the fuel pump core. Please refer to FIGS. 6 and 7 for details. It can be understood that when the electrically conductive plate is mounted in the clamping opening, the configuration of the electrically conductive plate is oblique along with the third bending portion, and the figure is merely for illustrative the purpose but does not show the oblique configuration of the electrically conductive plate.

In another usage manner, the electrically conductive plate is clamped in the clamping opening, the wiring terminal acts on the external surface of the connection arm B and presses the third bending portion against the electrically conductive plate clamped in the clamping opening, thereby implementing the electrical contact of the electrically conductive plate with the wiring terminal.

The fuel pump component of the present embodiment divides a portion of the fuel pump core that contacts the power supply into two parts, wherein a part is the electrically conductive plate extending outside on the fuel pump core in the housing, and another part is the wiring terminal that is fixedly provided on the cover. The housing is fitted with the cover to electrically connect the electrically conductive plate with the wiring terminal. Meanwhile, the wiring terminal is directly provided on the cover, so that the wiring terminal laterally extends outside, and further the wiring holder having the lateral opening can be provided on the cover to implement the lateral plug-insertion with the power supply and prevent rainwater from entering or dust falling into the wiring holder when it rains, thereby improving the electrical contact with the power supply. In addition, the electrically conductive plate of the present embodiment contacts the wiring terminal through the elastic insertion plate, which ensures the reliability of the electrical contact without the need for the process of welding or screwing, and has wide applicability.

What is claimed is:

1. A fuel pump component, comprising a housing and a cover, wherein the housing and the cover fit each other, a fuel pump core is provided in the housing, the fuel pump core is provided with an electrically conductive plate extending outside, a wiring terminal is provided on the cover, the wiring terminal is in electrical contact with the electrically conductive plate when the housing is fitted with the cover, a portion of the wiring terminal extends outside the cover wherein the portion of the wiring terminal is bent laterally, a wiring holder covering the wiring terminal is provided on the cover, and the wiring holder has a lateral opening, wherein the electrically conductive plate is connected to the wiring terminal through an elastic insertion plate, the elastic insertion plate is electrically conductive, and the elastic insertion plate has a clamping portion clamping the electrically conductive plate or the wiring terminal, and a contact portion contacting the wiring terminal or the electrically conductive plate to electrically connect the electrically conductive plate and the wiring terminal, and wherein the clamping portion comprises a left clamping arm and a right clamping arm, a first end of the left clamping arm is connected to a first end of the right clamping arm and a second end of the left clamping arm forms an elastic clamping opening, an abutting clamping surface is provided between the left clamping arm and the right clamping arm located at the elastic clamping opening, and the contact portion is an external surface of the left clamping arm or an external surface of the right clamping arm, wherein the contact portion is opposite to the abutting clamping surface.

2. The fuel pump component of claim 1, wherein the left clamping arm or the right clamping arm comprises a first connection arm, wherein a first end of the first connection arm is connected to the right clamping arm or the left clamping arm, and a second end of the first connection arm is connected to a first bending portion extending obliquely upward toward the right clamping arm or the left clamping arm, a second bending portion extending obliquely upward toward the first connection arm is connected to the first bending portion, and the first bending portion, the second bending portion and the first connection arm form a triangle shape.

3. The fuel pump component of claim 2, wherein the right clamping arm or the left clamping arm comprises a second connection arm, wherein a first end of the second connection arm is connected to the left clamping arm or the right clamping arm, and a second end of the second connection arm is connected to a third bending portion extending obliquely upward toward the left clamping arm or the right clamping arm, and the third bending portion abuts a connection portion of the first bending portion and the second bending portion to form the elastic clamping opening.

4. The fuel pump component of claim 1, wherein the right clamping arm or the left clamping arm comprises a second connection arm, wherein a first end of the second connection arm is connected to the left clamping arm or the right clamping arm, and a second end of the second connection arm is connected to a third bending portion extending obliquely upward toward the left clamping arm or the right clamping arm, and the third bending portion abuts a connection portion of the first bending portion and the second bending portion to form the elastic clamping opening.

5. The fuel pump component of claim 4, wherein, the electrically conductive plate is clamped in the elastic clamping opening, the wiring terminal acts on an external surface of the first connection arm and presses the connection portion of the first bending portion and the second bending portion against the electrically conductive plate clamped in the elastic clamping opening.

6. The fuel pump component of claim 4, wherein the electrically conductive plate is clamped in the elastic clamping opening, the wiring terminal acts on an external surface of the second connection arm and presses the third bending portion against the electrically conductive plate clamped in the elastic clamping opening.

7. The fuel pump component of claim 4, wherein the first connection arm and the second connection arm are connected through a lateral connection arm.

8. The fuel pump component of claim 7, wherein, the electrically conductive plate is clamped in the elastic clamping opening, the wiring terminal acts on an external surface of the first connection arm and presses the connection portion of the first bending portion and the second bending portion against the electrically conductive plate clamped in the elastic clamping opening.

9. The fuel pump component of claim 7, wherein the electrically conductive plate is clamped in the elastic clamping opening, the wiring terminal acts on an external surface of the second connection arm and presses the third bending portion against the electrically conductive plate clamped in the elastic clamping opening.

* * * * *